US005695291A

United States Patent [19]

Park

[11] Patent Number: 5,695,291

[45] Date of Patent: Dec. 9, 1997

[54] THERMAL-TRANSCRIPTION PRINTER

[75] Inventor: Geun-yong Park, Suwon, Rep. of Korea

[73] Assignee: Samsung Electronics Co., Ltd., Kyungki-Do, Rep. of Korea

[21] Appl. No.: 705,643

[22] Filed: Aug. 30, 1996

[30] Foreign Application Priority Data

Dec. 29, 1995 [KR] Rep. of Korea ..... 95-66916

[51] Int. Cl.[6] ..... B41J 23/34

[52] U.S. Cl. ..... 400/120.16; 400/185; 400/649; 347/220

[58] Field of Search ..... 400/120.16, 649, 400/185; 347/197, 215, 217, 220

[56] References Cited

U.S. PATENT DOCUMENTS 4,689,639 8/1987 Kimura et al. ..... 347/197
5,412,407 5/1995 Okubo et al. ..... 400/185
5,536,092 7/1996 Yamaguchi ..... 400/649

FOREIGN PATENT DOCUMENTS 62-271769 11/1987 Japan ..... 400/649
4-156372 5/1992 Japan ..... 347/220

*Primary Examiner*—Edgar S. Burr
*Assistant Examiner*—Leslie Grohusky
*Attorney, Agent, or Firm*—Sughrue, Mion, Zinn, Macpeak & Seas, PLLC

[57] ABSTRACT

A thermal-transcription printer has a printing head and a platen drum which is moved up and down to press thermally activated ink from a thermal transfer ribbon onto a paper. A lever member is installed on a feed roller for transferring a paper sheet, and the platen drum is supported by an end portion of the lever member. The platen drum moves up and down, while being supported by the lever member which rotates in the same direction as the feed roller, and presses an ink ribbon and the paper against the printing head.

9 Claims, 4 Drawing Sheets

THERMAL-TRANSCRIPTION PRINTER

BACKGROUND OF THE INVENTION

1. Field of the Invention

The present invention relates to a thermal-transcription printer, and more particularly, to an improved thermal-transcription printer in which a platen drum is moved up and down by a motor thereby pressing the platen drum against or detaching the platen drum from a printing head.

2. Description of the Related Art

In a conventional thermal-transcription printer, schematically illustrated in FIG. 1, printing is generally performed by pressing a thermal transfer ribbon, which moves back and forth, on a paper to sequentially position thermally activated color inks over the paper. A ribbon cartridge 20 is installed over a platen drum 33, and a printing head 12 is installed over the ribbon cartridge 20 to move up and down.

A supply reel 22 and a take-up reel 21 are rotatably disposed in the ribbon cartridge 20 for storing and winding a thermal transfer ribbon 23 which is coated section by section with thermally activated color inks such as yellow, magenta, cyan and black. The take-up reel 21 is rotated by driving a motor $M_1$. The printing head 12 is provided at an end portion of a lever member 10 which rotates in the directions indicated by bi-directional arrow A. The lever member 10 is rotated by a motor $M_3$ via a driving gear 11. Sensors $S_1$ and $S_2$ for detecting the position of the lever member 10 are installed above and below the lever member 10.

A feed roller 32 which is rotated by a motor $M_2$ and a guide roller 31 which is rotated in contact with the feed roller 32 are installed on the paper supplying side of the platen drum 33.

In the above thermal-transcription printer, the feed roller 32 and the guide roller 31 are rotated in response to actuation of the motor $M_2$ so that the paper 30 is fed to a printing position and the printing head 12 moves down in response to actuation of the motor $M_2$ to thereby press the ribbon 23 against the paper 30. When the paper 30 reaches a printing position, and the printing head 12 moves down the color inks from the ribbon 23 are thermally transferred to the paper. The required colors are overlapped to produce an image of the desired color in a known manner. Control of the print head and ribbon position can be accomplished by well known techniques. The printing head 12 presses the ribbon 23 toward the paper 30 during printing, and the printing head 12 is lifted up by the motor $M_3$ during movement of the paper to the printing position and to reposition the ribbon.

However, the conventional thermal-transcription printer described above has drawbacks in that the structure is complicated and the manufacturing cost thereof is high due to the employment of two separate motors $M_2$ and $M_3$ for rotating the feed roller 32 and for moving the printing head 12 up and down, respectively.

SUMMARY OF THE INVENTION

An object of the present invention is to provide a simple and improved thermal-transcription printer in which a feed roller and a printing head are driven by a single driving source.

To achieve the above object, there is provided a thermal-transcription printer comprising: a pair of frames; a platen drum between the frames; a printing head positioned over the platen drum having means for emitting heat in a predetermined pattern, the position of the platen drum being determined by a predetermined fixing means; a thermal transfer ribbon cartridge between the printing head and the platen drum, supported by the frames, and having a thermal transfer ribbon coated with sequential sections of thermally-activated color inks; a feed roller driven by a feed motor and installed at one side of the platen drum; a guide roller which rotates with the feed roller; and means for moving the platen drum up and down by the feed motor.

The fixing means comprises: a lever member having one end on which the printing head is supported and another end on which is rotatably installed to the frames; a rotational shaft rotatably supported between the pair of frames; a cam member coupled to the rotational shaft, and having an end portion which contacts the lever member; and a spring member for elastically biasing the lever member, wherein the end portion of the cam member presses against the upper surface of the lever member and the lever member is elastically biased toward the cam member due to the restoring force of the spring member.

The moving means comprises: an interlocking lever member one end of which is combined with a rotational shaft of the feed roller and the other end of which is combined with a rotational shaft of the platen drum; and contacting means for tightly pressing said interlocking lever member against said feed roller. Preferably, the contacting means comprises: a spring member combined with the rotational shaft of the feed roller, for elastically biasing the interlocking lever member along the axis of the rotational shaft; and a ring member combined with the rotational shaft, for preventing deviation of the spring member and the interlocking lever member. More preferably, the contacting means further comprises washers combined with the rotational shaft of the feed roller and disposed at either side of the interlocking lever member, and felt members disposed between the washers and the interlocking lever member.

The thermal-transcription printer of the invention is simple in structure, since the motor for driving the feed roller also moves the platen roller up and down to bring the platen roller into and out of contact with the printing head.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE PREFERRED EMBODIMENT

Figure 1:
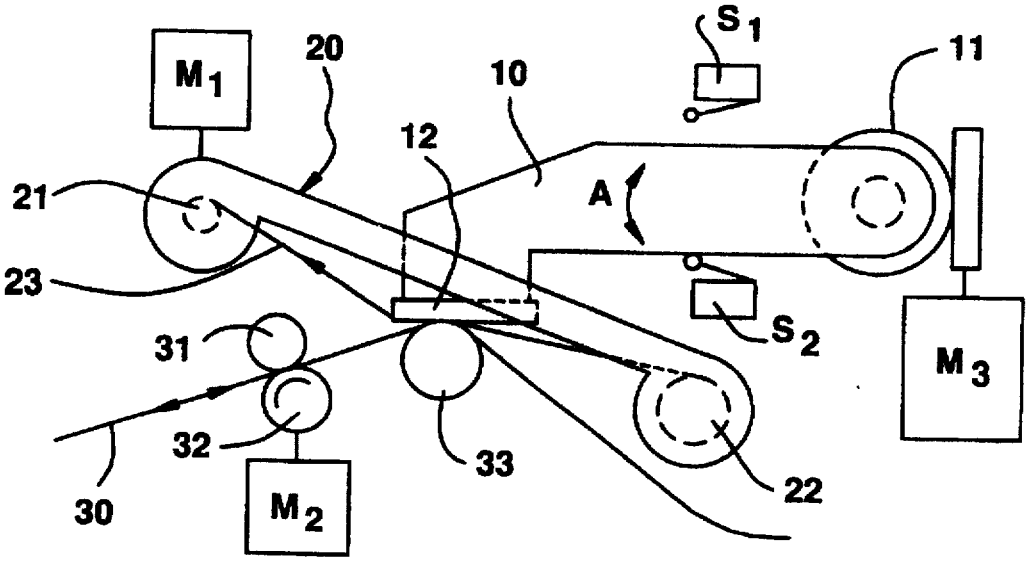
FIG.1 PRIOR ART
FIG. 1 is a schematic view of a conventional thermal-transcription printer.
Figure 2:
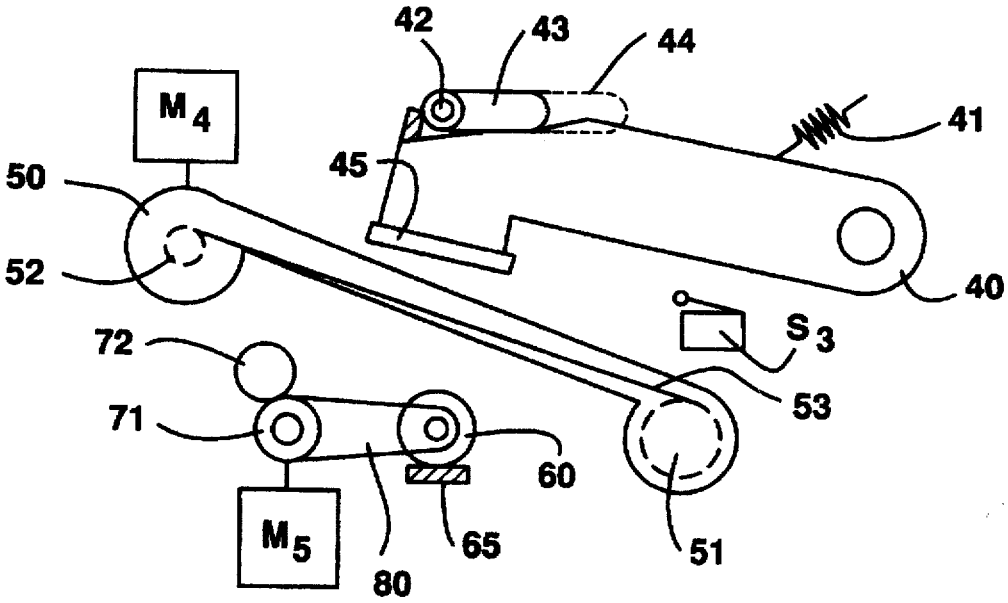
FIGS. 2–4 are schematic illustrations of a thermal-transcription printer according to a preferred embodiment of the present invention.
Figure 4:
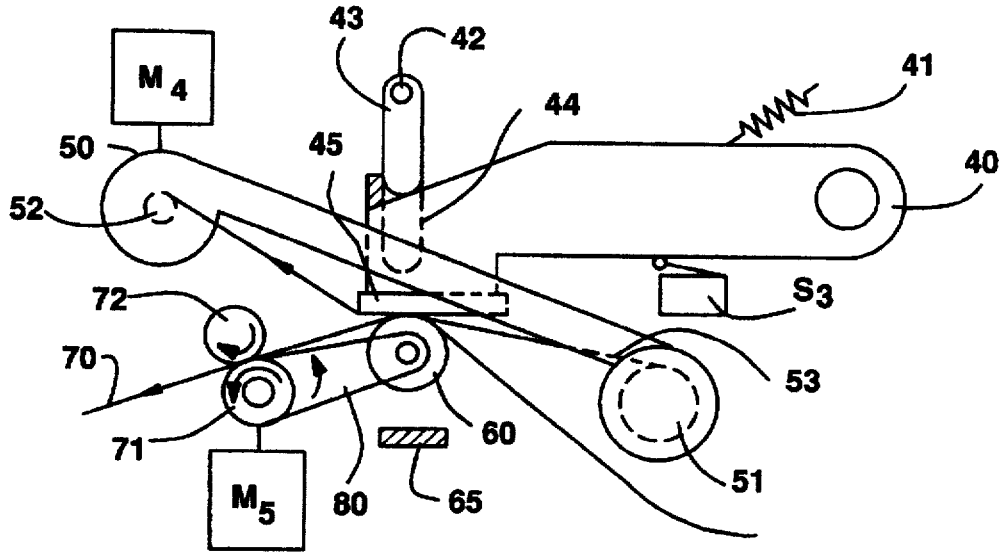
Figure 6:
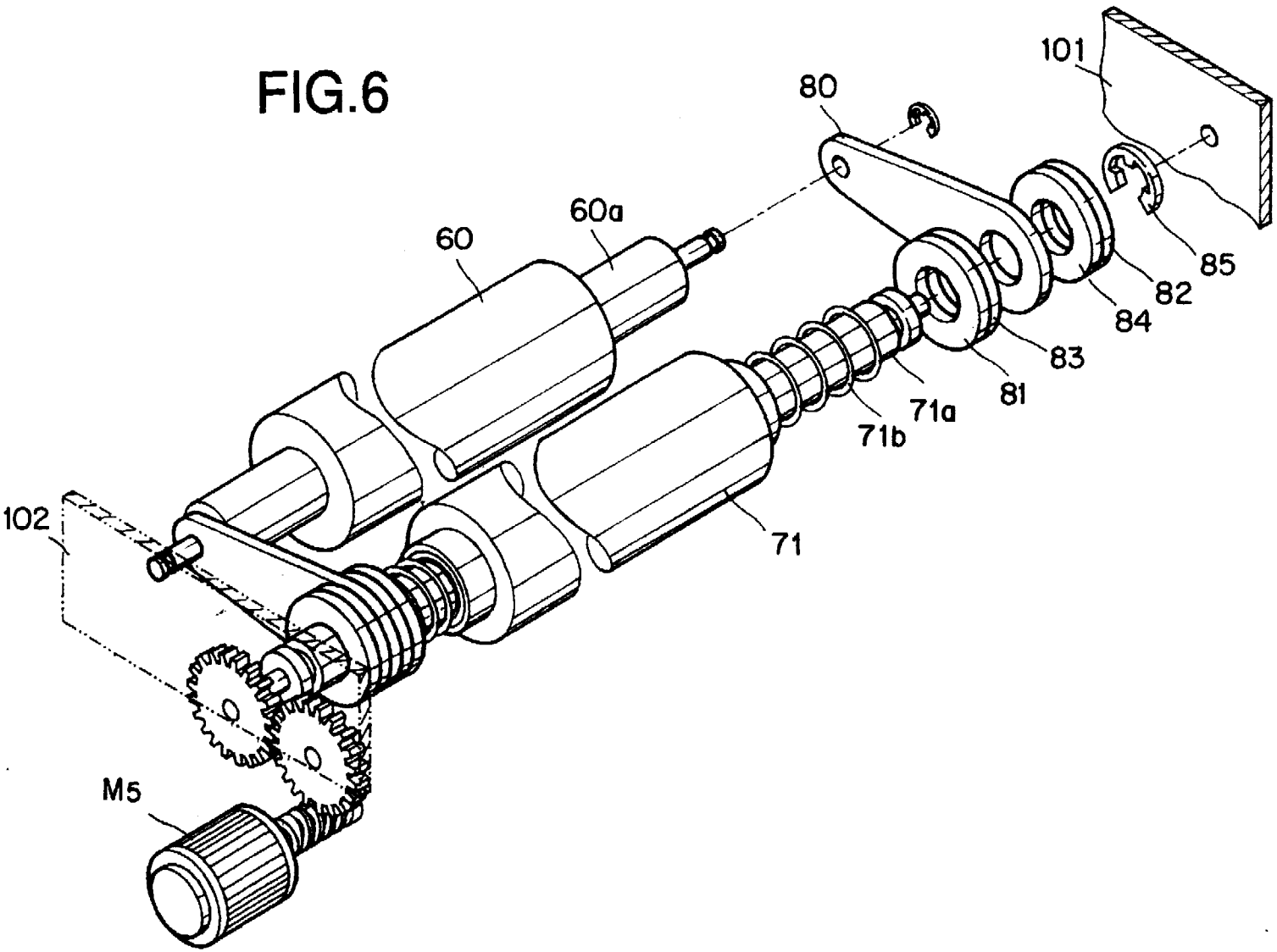
FIG. 6 is an exploded perspective view of a support for a platen roller in the thermal-transcription printer of the preferred embodiment.

Referring to FIGS. 2, 4 and 6 schematically illustrating a thermal-transcription printer according to a preferred embodiment of the present invention, a cylindrical platen drum 60 is disposed between a pair of frames 101 and 102. A ribbon cartridge 50 is provided over the platen drum 60, and supported by the frames 101 and 102. A supply reel 51 and a take-up reel 52 are rotatably disposed in the cartridge 50 for storing and winding a thermal transfer ribbon 53 which is coated with thermally-activated color inks of different colors.

Figure 5:
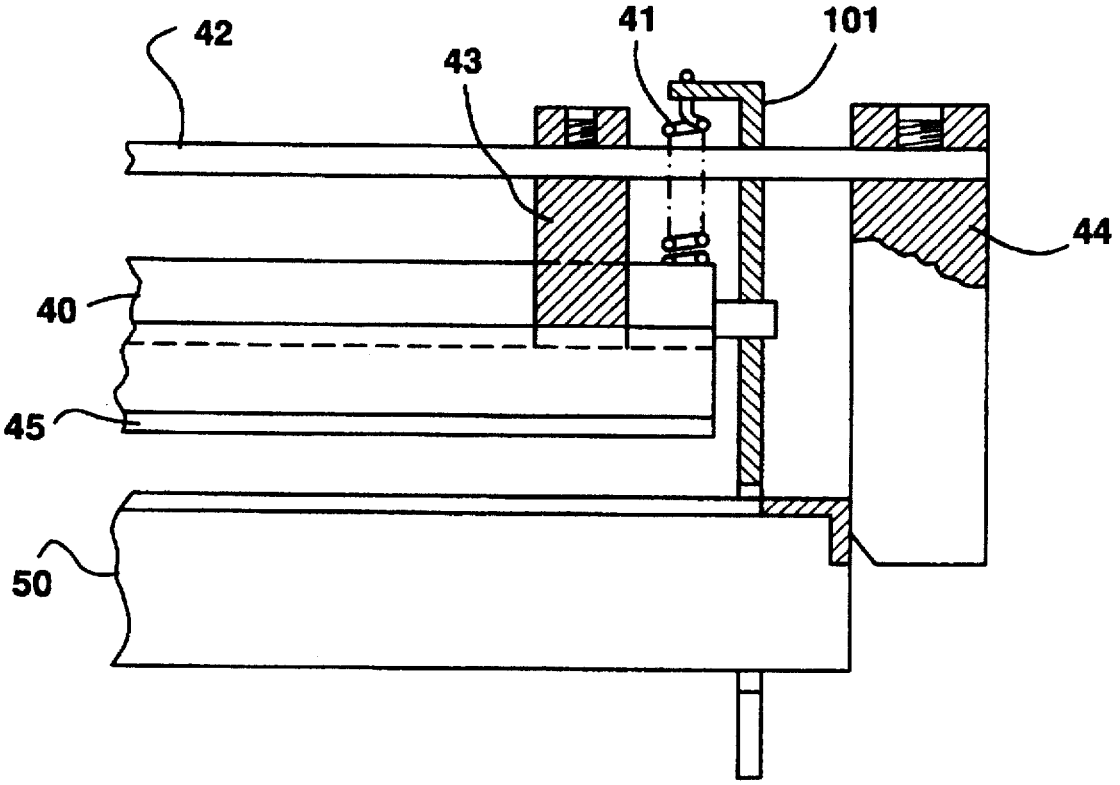
FIG. 5 is a sectional view of an essential portion of the thermal-transcription printer of the preferred embodiment.

A printing head 45, which is fixed in place by a predetermined fixing means, is disposed above the center portion of the cartridge 50. As shown in FIG. 5, the fixing means comprises: a lever member 40, one end of which supports the printing head 45 and the other end of which is rotatably installed to the pair of frames 101 and 102; a rotational shaft 42 rotatably supported between the frames 101 and 102; a cam member 43 to which the rotational shaft 42 is coupled and one end portion of the cam contacts the lever member 40; and a spring member 41 for elastically biasing the lever member 40 upward. The rotational shaft 42 is combined with a supporting member 44 for supporting the ends of the cartridge 50 installed in the frames 101 and 102. A sensor member $S_3$ is installed at a predetermined position under the lever member 40.

In the above thermal-transcription printer, after the cartridge 50 is installed in the frames 101 and 102, the supporting member 44 is rotated and positioned around the outer ends of the cartridge 50, thereby stably supporting the cartridge 50 by preventing the cartridge 50 from rocking side-to-side (see FIG. 5). Meanwhile, the cam member 43 is rotated simultaneously with the supporting member 44, and the end portion of the cam member 43 contacts the lever member 40 to move the lever member 40 downward. At this time, the spring member 41 is stretched. When the sensor member $S_3$ senses the lever member 40 as the lever member 40 is lowered, the cam member 41 stops rotating. At this time, the lever member 40 is elastically biased upward by a restoring force of the spring member 41 and lever member 40 presses against the end portion of the cam member 43, thereby stabilizing the lever member 40 at this position (see FIGS. 3 and 4. It is preferable that the pair of supporting members 44 are provided to support both ends of the cartridge 50 simultaneously. Meanwhile, a feed roller 71 which is driven by a feed motor $M_5$ is installed at one side of the platen drum 60, and a guide roller 72 is installed to rotate in contact with the feed roller 71.

Also, a moving means is provided to move the platen drum up and down by the force of the feed motor $M_5$. Referring to FIG. 6, the moving means has an interlocking lever member 80 one end of which is combined with an end of a rotational shaft 71*a* of the feed roller 71 and the other end of which is combined with a rotational shaft 60*a* of the platen drum 60 and a contacting means for tightly contacting the interlocking lever member 80 with the feed roller 71. The contacting means includes a spring member 71*b* combined with the rotational shaft 71*a* of the feed roller 71 for elastically biasing the interlocking lever member 80 outward along the axis of the rotational shaft 71*a*, and a locking member 85 combined with the rotational shaft 71*a* for preventing the lever member 80 from separating from the axis of the shaft 71*a* of the spring member 71*b*. Washers 81 and 82 are provided at either side of the interlocking lever member 80, and felt rings 83 and 84 are provided between the interlocking lever member 80 and the washer members 81 and 82. A stopper 65 is installed under the platen drum 60 to limit the downward movement of the platen drum 60. The stopper can be mounted on frames 101 and 102. One interlocking lever member 80 and one contacting means are provided at each side of the feed roller 71.

The preferred embodiment operates as follows.

Figure 3:
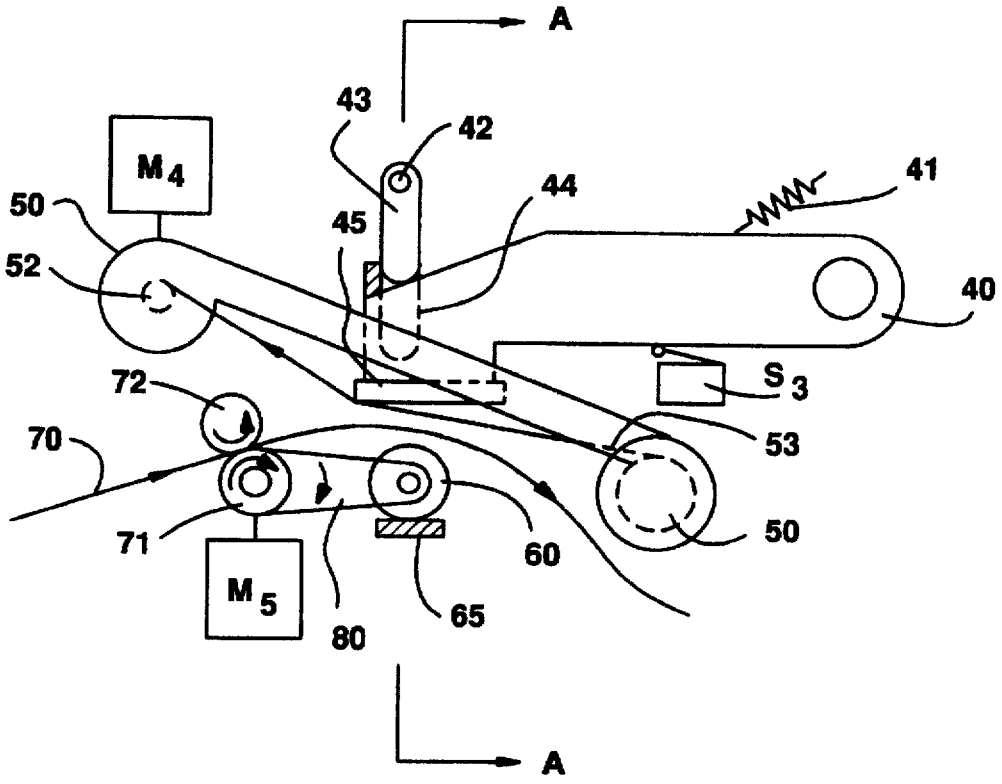

First, as shown in FIG. 2, when the lever member 40 which supports the printing head 45 is released from the cam member 43, the cartridge 50 is supported by the frames 101 and 102. For example, ends of the cartridge 50 extend through holes formed in the frames 101 and 102. Referring to FIG. 3, as described above, the supporting member 44 is rotated so that its end portion contacts with the cartridge 50 (see FIG. 5). In the meantime, the cam member 43 is rotated simultaneously with the supporting member 44, and the end portion of the cam member 43 contacts with the lever member 40, thereby moving the lever member 40 downward. At this time, the spring member 41 is stretched. When the sensor member $M_3$ senses the lever member 40, the cam member 43 stops rotating. The lever member 40 is now elastically biased upward, and is pressed against the end portion of the cam member 43. Thus, the position of the lever member 40 is maintained. In this state, the printing head 45 is a predetermined distance away from the platen drum 60.

As shown in FIG. 3, the feed roller 71 is now rotated clockwise by the force of the feed motor $M_5$. Paper 70 is thus supplied to the platen drum 60 by the pressure of the feed roller 71 and the guide roller 72. The interlocking lever member 80 is rotated with the rotating feed roller 71 so as to move the platen drum 60 downward. Since movement of the platen drum 60 is limited by the stopper 65, the platen drum 60 moves to a predetermined position. Thus, the paper supply path is shortened, thereby enabling the paper to be supplied rapidly.

When the paper is placed in a designated printing position, the feed motor $M_5$ stops. Then, the take-up reel 52 of the cartridge 50 is rotated by driving the motor $M_4$ and winds the ribbon 53. When the yellow segment of the rolling ink ribbon 53 is placed in the printing position, the motor $M_4$ stops.

Thereafter, as shown in FIG. 4, the feed roller 71 is rotated counterclockwise by driving the feed motor $M_5$, and the interlocking lever member 80 is rotated counterclockwise. The platen drum 60 thus presses the ink ribbon 53 and the paper 70 against the printing head 45. The spring member 71*b* and the felt members 83 and 84 prevent the interlocking lever member 80 from sliding along the feed roller 71.

As described above, the paper is moved to the left by the counterclockwise rotation of the feed roller 71, and a yellow image component is printed on the paper 70.

When the yellow image component is completely printed on the paper 70, the feed roller 71 is rotated clockwise again by driving the feed motor $M_5$ in reverse, and thus the paper 70 is moved to the printing position. The interlocking lever member 80 is thus rotated clockwise and moves the drum 60 downward. Then, the ribbon 53 is wound by the force of the motor $M_4$, thereby placing the magenta segment in the printing position.

Yellow, magenta, cyan, and black image components are printed on the paper 70, overlapping one another, through repetition of the above procedure. The general operation of the print head and the cartridge 50 can be similar to known devices.

As described above, in the thermal-transcription printer of the preferred embodiment, the platen drum 60 is moved down by the rotational force of the feed roller 71 and presses the ribbon 53, without requiring an extra driving source for moving the printing head 45 up and down.

Control of the various components can be accomplished by a microprocessor based controller, or the like, programmed in a desired manner and various known actuation devices, such as motors and solenoids, and known sensors.

What is claimed is:

1. A thermal-transcription printer comprising:

a pair of frames;

a platen drum disposed between said frames;

a printing head positioned over said platen drum, said printing head having means for emitting heat in a predetermined pattern;

fixing means for supporting said printing head;

a thermal transfer ribbon cartridge disposed between said printing head and said platen drum and being supported by said frames, said ribbon cartridge having a thermal transfer ink ribbon;

a feed roller driven by a feed motor and installed on one side of said platen drum;

a guide roller in rotatable contact with said feed roller for transferring a paper sheet; and means for moving said platen drum up and down by said feed motor.

2. A thermal transcription printer as claimed in claim 1, wherein said ink ribbon is coated with sequential sections of predetermined thermally activated color inks.

3. A thermal-transcription printer as claimed in claim 2, wherein the fixing means comprises:

a lever member having one end on which said printing head is supported and another end which is rotatably installed to said frames;

a rotational shaft rotatably supported between said pair of frames;

a cam member coupled to said rotational shaft, and an end portion of said cam member contacts said lever member; and a spring member for elastically biasing said lever member;

wherein the end portion of said cam member presses against the upper surface of said lever member and said lever member is elastically biased toward said cam member due to the force of said spring member.

4. A thermal-transcription printer as claimed in claim 3, wherein a supporting member for supporting either end of said cartridge is coupled to said rotational shaft.

5. A thermal-transcription printer as claimed in claim 2, wherein said moving means comprises:

an interlocking lever member having one end which is combined with a rotational shaft of said feed roller and another end which supports a rotational shaft of said platen drum; and contacting means for tightly pressing said interlocking lever member against said feed roller.

6. A thermal-transcription printer as claimed in claim 5, wherein said contacting means comprises:

a spring member disposed on said rotational shaft of said feed roller, for elastically biasing said interlocking lever member along the axis of said rotational shaft; and a locking member disposed around said rotational shaft, for preventing the deviation of said spring member and said interlocking lever member.

7. A thermal-transcription printer as claimed in claim 5, further comprising a stopper for limiting the downward movement of said platen drum.

8. A thermal-transcription printer as claimed in claim 6, wherein said contacting means further comprises washers disposed around said rotational shaft of said feed roller and disposed at either side of said interlocking lever member, and felt members disposed between said washers and said interlocking lever member.

9. A thermal-transcription printer as claimed in claim 3, further comprising means for detecting the position of said lever member.

* * * * *